US006277213B1

(12) United States Patent
Schenker

(10) Patent No.: US 6,277,213 B1
(45) Date of Patent: Aug. 21, 2001

(54) SURFACE TREATMENT OF STEEL OR A NICKEL ALLOY AND TREATED STEEL OR NICKEL ALLOY

(75) Inventor: Erhard Schenker, Kirchdorf (CH)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/327,006

(22) Filed: Jun. 7, 1999

Related U.S. Application Data

(63) Continuation of application No. PCT/EP97/06839, filed on Dec. 8, 1997.

(30) Foreign Application Priority Data

Dec. 6, 1996 (CH) ..... 3001/96

(51) Int. Cl.[7] ..... C23C 22/00

(52) U.S. Cl. ..... 148/243; 148/277; 148/287; 252/186.43; 428/472.2

(58) Field of Search ..... 148/243, 277, 148/287; 252/186.43; 428/472.2

(56) References Cited

U.S. PATENT DOCUMENTS

| | | | | |
|---|---|---|---|---|
| 2,890,974 | | 6/1959 | Carrigan . | |
| 3,888,702 | | 6/1975 | Kujawa et al. . | |
| 4,581,074 | * | 4/1986 | Mankina et al. | 134/2 |
| 4,820,473 | * | 4/1989 | Ohashi et al. | 376/305 |
| 4,946,518 | | 8/1990 | Spanjer et al. . | |
| 5,532,024 | | 7/1996 | Arndt et al. . | |
| 5,797,357 | * | 8/1998 | Kawachi et al. | 122/398 |

FOREIGN PATENT DOCUMENTS

| | | |
|---|---|---|
| 710733 | 8/1941 | (DE) . |
| 740432 | 9/1943 | (DE) . |
| 1 928 307 | 12/1970 | (DE) . |
| 1 928 307 | 10/1971 | (DE) . |
| 22 63 500 B2 | 6/1975 | (DE) . |
| 44 24 638 A1 | 4/1996 | (DE) . |
| 0 482 614 A1 | 4/1992 | (EP) . |
| 0 352 399 B1 | 5/1992 | (EP) . |
| 2.085.804 | 12/1971 | (FR) . |
| 7111732 | 12/1971 | (FR) . |

OTHER PUBLICATIONS

Japanese Patent Abstract 59157285 (Hiroshi), dated Sep. 6, 1984.
Derwent Abstract No. 88–067199 [10]; Jan. 1988.
Derwent Abstract No. 93–392984 [49]; Nov. 1993.
Derwent Abstract No. 79–74744B [41]; Feb. 1979.
Derwent Abstract No.80–61677C [35]; Apr. 1980.
Derwent Abstract No. 88–067200 [10]; Jan. 1988.
Derwent Abstract No. 95–381540 [49]; May 1995.
Derwent Abstract XP–002065145; 1985.
Brockhaus Enzyklopädie, vol. 16, p. 585, 19$^{th}$ ed., 1991, encyclopedia.

* cited by examiner

*Primary Examiner*—John Sheehan
*Assistant Examiner*—Andrew L. Oltmans
(74) *Attorney, Agent, or Firm*—Herbert L. Lerner; Laurence A. Greenberg; Werner H. Stemer

(57) ABSTRACT

The invention relates to a process for the surface treatment of stainless steel and/or of a nickel alloy. It also relates to the use of such a process and to a stainless steel treated by the process or of a treated nickel alloy. It is envisaged that the treatment is carried out with peroxide or with a water/peroxide mixture or with a peroxide solution.

22 Claims, 1 Drawing Sheet

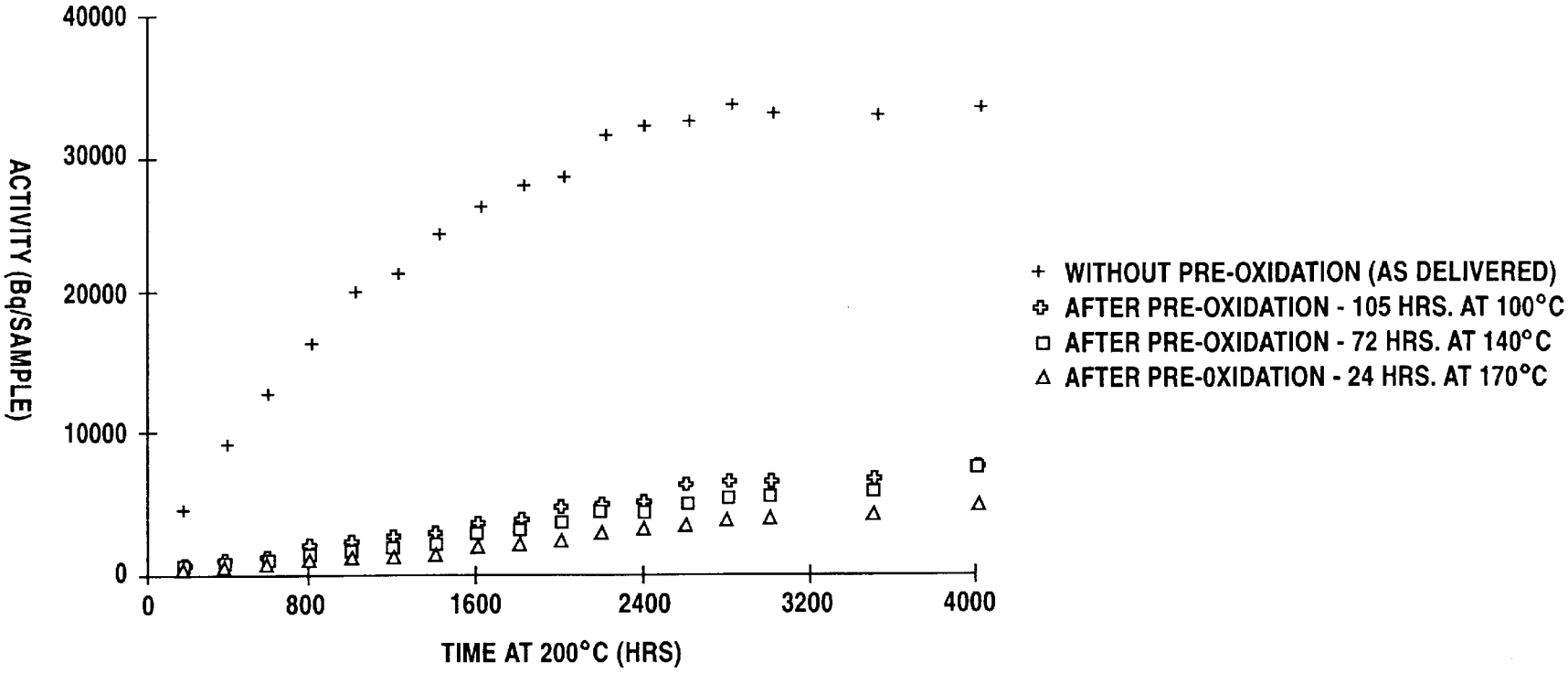
+ WITHOUT PRE-OXIDATION (AS DELIVERED)
AFTER PRE-OXIDATION - 105 HRS. AT 100°C
AFTER PRE-OXIDATION - 72 HRS. AT 140°C
AFTER PRE-OXIDATION - 24 HRS. AT 170°C
ACTIVITY (Bq/SAMPLE)
40000
30000
20000
10000
0
0
800
1600
2400
3200
4000
TIME AT 200°C (HRS)

SURFACE TREATMENT OF STEEL OR A NICKEL ALLOY AND TREATED STEEL OR NICKEL ALLOY

CROSS-REFERENCE TO RELATED APPLICATIONS

This is a continuation of copending International Application PCT/EP97/06839, filed Dec. 8, 1997, which designated the United States.

BACKGROUND OF THE INVENTION

Field of the Invention

The invention relates to a process for the surface treatment of alloys comprising nickel and iron, in particular of stainless steel, and/or of a nickel alloy comprising 10–70% nickel. The invention also relates to uses for such a process and to a steel or a nickel alloy produced by such a process.

The steels are, for example, austenitic chrome-nickel steels, and the nickel alloys are, for example, of the Incoloy 800, Inconel 600 or similar types. One application of the process can be in nuclear technology for reducing the later absorption of activity (contamination) of components of the primary circulation of water-cooled nuclear power stations before a new installation or after a decontamination.

In water-cooled nuclear power stations such as, for example, boiling-water reactors (BWR) and pressurized-water reactors (PWR), oxide layers form, owing to reaction with the hot water and/or steam, on the wetted surfaces which for the major part consist of zirconium alloys and austenitic chromium-nickel steels (so-called stainless steel). Part of these oxide layers passes, owing to dissolution or erosion, into the water circulations and can be activated in the neutron field. If the activated corrosion products are incorporated outside the reactor core on surfaces of components into oxide layers present therein or deposited thereon as particles, these components are radioactively contaminated. Components at risk of contamination are, in the pressurized-water reactor, above all main coolant pumps and steam generators, and, in the case of older boiling-water reactors with external circulation, the components at risk are the recirculation lines and the reactor water purification system.

In order, then, to avoid an impermissible radiation exposure of the operating personnel during operation, inspection, maintenance work and repairs, this contamination must be minimized as far as possible. This can be effected by a careful selection of the materials and the operating parameters such as, for example, the water chemistry. If the contamination nevertheless rises to inadmissible values, such systems must be decontaminated. This is done by a chemical treatment, by means of which the oxide layer and thus the activated corrosion products contained therein are removed.

In the past, many part-systems of nuclear power stations were routinely decontaminated, such as the main coolant pumps, the steam generators or parts thereof in pressurized-water reactors, and the circulation loops and the purification system in the case of a boiling-water reactor. These decontamination processes are nowadays state of the art and are commercially available. As a rule, decontamination factors of between 10 and far more than 100 are achieved in this way.

For economic and technical reasons, only the directly interfering contaminants are removed in most cases, whereas the predominant part of the surfaces such as, for example, the surfaces of the fuel elements, are not treated, in order to minimize the volume of the radioactive wastes which arise during the decontamination and must ultimately be dumped. When the components thus cleaned are taken back into operation, their surfaces in contact with the coolant are very rapidly covered again with an oxide layer. This oxide layer reaches an equilibrium with the activation products which are present in the coolant or which pass into the coolant from the non-decontaminated surfaces. The consequence thereof is a very rapid recontamination of the cleaned surfaces. Even when components are replaced, a very rapid contamination thereof is observed. The recontamination of cleaned surfaces or the contamination of newly installed surfaces can, in a short time, assume values which are higher than those before the decontamination. This has been observed, for example, in the circulation loops in a nuclear power station after the replacement of the circulation loops.

In the past, diverse attempts have been made to pretreat the decontaminated surfaces or the surfaces newly to be used in such a way that the contamination starts only to a reduced extent. For this purpose, the following approaches are available in principle:

- Reduction in the activation products available. This can be effected by a so-called complete system decontamination including the fuel elements. A great disadvantage is that large volumes of radioactive wastes arise.
- The preparation of surfaces which are contaminated more slowly, for example by electropolishing. This is, however, practicable only in the replacement of systems and was not successful in the case of a nuclear power station selected for experiment.
- Coating of the cleaned or new surface with a non-contaminated oxide layer. This can be done by various processes such as, for example, with oxygen-containing steam or with water having high oxygen contents. This requires treatments for relatively long periods and/or at high temperatures. These processes have so far not been very successful as, for example, the treatment of the new and electropolished recirculation line in a selected nuclear power station remained without any noticeable effect.

SUMMARY OF THE INVENTION

It is accordingly an object of the invention to provide a process for surface treating an alloy comprising nickel and iron that overcomes the problems described above, in particular to provide a process which has the following properties:

- a simple treatment, as far as possible in the power station itself;
- short treatment time and low process temperatures;
- unproblematic auxiliaries, i.e. non-hazardous chemicals which cannot lead to consequential damage or long-term damage, even if residues remain in the systems;
- the surfaces or protective layers produced must in the subsequent operation of the plant be effective and stable for a very long time and, in particular, they must not become detached;
- the components must not be damaged by the treatment and
- produced protective layers and layers which form during the subsequent normal operation of the nuclear power stations must be removable again by decontamination processes nowadays familiar in practice.

It is also an object of the invention to provide suitable uses of the process and to provide an alloy such as stainless steel or nickel alloy to be obtained by such a process.

With the foregoing and other objects in view, there is provided, in accordance with the invention, a process for preventing formation of an oxide layer enriched with radioactive substances on a surface of an alloy comprising nickel and iron, in which an oxide layer of 20 nm minimum thickness is formed on the surface by treatment thereof with aqueous hydrogen peroxide before the surface can come into contact with radioactive substances.

In accordance with a particular feature of the invention, the alloy surface is a surface comprising stainless steel, i.e. austenitic chrome-nickel alloy steel. In a further feature of the invention, the alloy surface is a surface comprising a higher nickel content alloy containing 10–70% nickel, such as Inconel 600 and Incoloy 800 alloys well known in the art.

In accordance with a further feature of the invention, the oxide layer produced by the process comprises nearly pure iron oxide.

In accordance with another feature of the invention, the process is advantageously used for the treatment of wetted surfaces in water-cooled nuclear power stations, which surfaces consist for the major part of stainless steels and/or nickel alloys, for example of the Incoloy 800, Inconel 600 or similar types, which are used especially in steam generators of pressurized-water reactors.

In accordance with yet another feature of the invention, it has been found that color is imparted to a stainless steel surface or nickel alloy surface treated with aqueous hydrogen peroxide according to the process of the invention.

In accordance with one more feature of the invention, there is provided a stainless steel or nickel alloy surface having an oxide layer of 20 nm minimum thickness as a result of treatment with aqueous hydrogen peroxide according to the process of the invention.

BRIEF DESCRIPTION OF THE DRAWING

FIG. 1 is a graph in which the deposition behavior of the isotope Co-58 under primary-water conditions of a boiling-water reactor on a steel, identified as material No. 1.4571 (X10CrNiMoTi1810), is shown as a plot of activity against time from 0 to 4000 hours at 290° C. Curves are drawn for the steel as supplied and after oxidation treatment with hydrogen peroxide solution for 105 hours at 110° C., for 72 hours at 140° C., and for 24 hours at 170° C.

DESCRIPTION OF THE PREFERRED EMBODIMENTS

In accordance with the invention, the surface of the stainless steel or nickel alloy is treated with peroxide or with a water/peroxide mixture or with a peroxide solution. All of these are embraced by the term "aqueous hydrogen peroxide" throughout the specification and claims.

The treatment takes place, suitably, under water, for example, by the addition of hydrogen peroxide to the water in contact with the surface. Preferably, the process for the surface treatment of stainless steel and/or high nickel content alloys, for example of the Incoloy 800, Inconel 600 and similar types, which are used especially in steam generators of pressurized-water reactors, provides that the surface to be treated is first cleaned and degreased by generally used techniques such as, for example, by a chemical treatment. The actual treatment can be carried out with a peroxide solution having a peroxide concentration of 0.1 to 200 mmol of $H_2O_2$ in, for example, pure or deionized water. This treatment can take place in an open or closed system.

As a rule, concentrations higher than 10 mmol of $H_2O_2$ provide no further essential advantages within the meaning of the invention, since excess hydrogen peroxide is rapidly decomposed thermally and catalytically, i.e. remains ineffective for the desired layer formation.

The object of providing a suitable use for the process is achieved according to the invention by the treatment of wetted surfaces in water-cooled nuclear power stations, which surfaces consist for the major part of stainless steels and/or high nickel content nickel alloys containing 10–70% nickel, for example of the Incoloy 800, Inconel 600 or similar types, which are used especially in steam generators of pressurized-water reactors and which, due to contamination, have led in the past to the problems mentioned at the outset.

The object of providing a suitable steel and/or a suitable nickel alloy is achieved according to the invention by the providing a stainless steel or nickel alloy with an oxide layer of minimum 20 nm thickness resulting from a process according to the invention.

If a protective layer which is stable during operation is to be built up within a short time and at temperatures which are low relative to the operating temperatures, oxide layers such as are also formed in normal operation are here the obvious answer. Since, however, the reaction rate of the oxidation by decomposition of the water or with oxygen at these temperatures is not sufficient, various oxidizing agents such as ozone, chromic acid and salts thereof, permanganic acid and salts thereof and also hydrogen peroxide were investigated. Among all the additives investigated in initial experiments, hydrogen peroxide proved to be outstandingly suitable, because

- stable protective layers which are resistant for long periods even in normal operation of boiling-water and pressurized-water reactors are obtainable with hydrogen peroxide at relatively low temperatures and during short treatment times,
- hydrogen peroxide does not represent a foreign substance in the water chemistry of nuclear power stations, since hydrogen peroxide is continuously formed in the coolant by radiolysis and, owing to its high decomposition rate at operating temperature, nevertheless no significant concentration is reached, and
- these protective layers have proved to be extremely stable during aging tests under operating conditions, i.e. they changed neither qualitatively not quantitatively for a long time and, compared with untreated surfaces, absorbed more than 80% less of activated corrosion products, for example of the cobalt isotopes Co-60 and Co-58 which are particularly disadvantageous for radiation protection reasons.

The layer produced by means of hydrogen peroxide differs fundamentally in its composition and structure from layers formed atmospherically or only with hot water. Whereas, in the case of atmospheric oxidation, mainly chromium-rich oxide layers and, in hot water without hydrogen peroxide, predominantly nickel spinels are formed, almost pure iron (III) oxides result with hydrogen peroxide. Oxide layers without hydrogen peroxide provide only slight protection from further oxidation or none at all in hot water/steam (further spinel layers form), whereas layers which have been formed under hydrogen peroxide are very stable and, especially during the later use under the conditions of the primary circulation of a nuclear power station, do not permit any spinel formation.

One advantage of the present invention is that the components which have surfaces to be treated can be either dismantled or treated separately. Systems such as vessels, piping, pumps, can also be treated in the installed state, by being coated on their inside which is exposed to water.

A further advantage of the treatment of steels with hydrogen peroxide is that the surface treatment of the steel can be visually monitored by the color change. Owing to interference, colorations of the surface, treated by the process according to the invention, from deep golden to dark blue/violet result. In principle, all spectral colors occur, depending on the layer thickness and on the type of light reflection.

The resulting coloration of stainless steel is not known from the state of the art. Thus, the process according to the invention is also generally suitable for coloring stainless steel or nickel alloys, by treating the cleaned surface with, for example, peroxide under water. The coloration is of interest not only in connection with the specifically indicated uses of the process in nuclear technology, but also in non-nuclear fields.

Suitable layer thicknesses are those from about 20 nm up to about 300 nm or between about 0.02 and up to about 0.3 $\mu$m. Such a layer thickness is obtained, for example, during a treatment time of between 10 hrs and 300 hrs.

The process according to the invention will be described by way of example in the context of some process conditions and with reference to the concrete examples which follow.

The pre-oxidation of the stainless steel or nickel alloy surface with hydrogen peroxide takes place in such a way that the coating can take place below 100° C. in an open or closed vessel, and also at temperatures above 100° C. in a closed vessel. Systems to be coated, for example in nuclear technology, can also be used directly as vessels. The latter is the case when the systems, vessels, piping, pumps and the like are to be coated on their inside where they are subject to water, such as is the case, for example, in cooling systems in nuclear power stations.

The procedure in this case is as follows: The vessel or the systems are filled with pure water or deionized water. Preferably, the pure water is circulated or continuously added. The water is brought by means of suitable devices to the desired treatment temperature and held there. At the same time, a diluted solution of hydrogen peroxide is added, so that the desired concentration of hydrogen peroxide can always be maintained. In the treatment of closed systems, for example at temperatures above 100° C. and pressures higher than 1 bar, it is sensible to fit effective venting, in order to remove the oxygen gas, which is formed during the thermal and catalytic decomposition of excess hydrogen peroxide, and to avoid a gas cushion which could prevent complete coating of the systems/vessels.

EXAMPLE 1

Open Vessel (Unpressurized)

Temperature: <100° C.
Pressure: Atmospheric
Concentration: 0.1 to 100 mmol of $H_2O_2$*

* Concentrations higher than 100 mmol can indeed be used, but they provide no advantages within the objective of the process, since excess hydrogen peroxide is rapidly decomposed thermally and catalytically, that is to say remains ineffective for the desired layer formation.

Water velocity: 0 to <10 m/s
Treatment time: 10 to <300 hrs

EXAMPLE 2

Closed Vessel or System

Temperature: >100° C.
Pressure: >1 bar, depending on the temperature, so that no steam head is formed or the system remains completely filled with pressurized water.
Concentration: 0.1 to 100 mmol of $H_2O_2$*

* Concentrations higher than 100 mmol can indeed be used, but they provide no advantages within the objective of the process, since excess hydrogen peroxide is rapidly decomposed thermally and catalytically, that is to say remains ineffective for the desired layer formation.

Water velocity: 0 to >10 m/s
Treatment time: 10 to >300 hrs

EXAMPLE 3

140° C.

Pressure: >5 bar
Concentration: 0.1 to 100 mmol of $H_2O_2$*

* Concentrations higher than 100 mmol can indeed be used, but they provide no advantages within the objective of the process, since excess hydrogen peroxide is rapidly decomposed thermally and catalytically, that is to say remains ineffective for the desired layer formation.

Water velocity: 0 to >10 m/s
Treatment time: 10 to 200 hrs

EXAMPLE 4

170° C.

Pressure: >10 bar
Concentration: 0.1 to 100 mmol of $H_2O_2$*

* Concentrations higher than 100 mmol can indeed be used, but they provide no advantages within the objective of the process, since excess hydrogen peroxide is rapidly decomposed thermally and catalytically, that is to say remains ineffective for the desired layer formation.

Water velocity: 0 to >10 m/s
Treatment time: 10 to 100 hrs

Of course, the present invention is not restricted to the examples given. These serve only for a better understanding of the present invention.

In principle, the present invention provides a process for the surface treatment of alloys comprising nickel and iron, such as especially stainless steel, and of nickel alloys, for example of the Incoloy 800, Inconel 600 and similar types, such as are used in particular in steam generators of pressurized-water reactors, the treatment being carried out with peroxide or a water/peroxide mixture or solution. The important point here is that a protective layer of oxide is formed on the treated surface. The surface can be the surface of a vessel, a pipe, a pump, and the like. In boiling-water reactors, it might be possible, for example, also to treat the feedwater preheaters by means of the process mentioned here, in order to reduce the introduction of corrosion products into the reactor.

The coating according to the invention in particular achieves the advantage that, in the operation of an installation, a surface contamination later can occur only with difficulty or not at all.

I claim:

1. A process for preventing formation of an oxide layer enriched with radioactive substances on a surface of an alloy comprising nickel and iron, in which an oxide layer of 20 nm minimum thickness is formed on the surface by treatment thereof at a temperature not exceeding 170° C. with aqueous hydrogen peroxide before the surface is contacted with radioactive substances.

2. Process according to claim 1, in which the alloy comprises stainless steel.

3. Process according to claim 1, in which the alloy comprises 10–70% nickel.

4. Process according to claim 1, in which the oxide layer comprises iron oxide.

5. Process according to claim 1, in which the surface to be treated is first cleaned and/or degreased.

6. Process according to claim 1, in which the surface to be treated is in contact with water.

7. Process according to claim 6, in which hydrogen peroxide is added to the water.

8. Process according to claim 1, in which the peroxide solution contains from 0.1 to 200 mmol of $H_2O_2$ per liter.

9. Process according to claim 1, in which the peroxide solution contains from 0.1 to 100 mmol per liter.

10. Process according to claim 1, in which the peroxide solution is a solution in pure or deionized water.

11. Process according to claim 1, in which the peroxide solution is circulated and/or continuously added.

12. Process according to claim 1, in which the treatment time is 10 to 300 hours.

13. Process according to claim 1, in which the treatment is carried out in in a system open to the atmosphere at a temperature of the solution of <100° C. and at atmospheric pressure and a solution velocity along the surface of 0 to <10 m/s, and in which a desired concentration of peroxide is continuously maintained by addition of peroxide.

14. Process according to claim 1, in which the treatment takes place in a system closed from the atmosphere at a temperature of at least 100° C. and at a pressure of >1 bar, and in which venting is provided for resulting oxygen gas.

15. Process according to claim 13, in which the treatment takes place in a temperature range from 120 to 170° C. and in a pressure range from 5 to 15 bar, and at a solution velocity along the surface of from 0 to 10 m/s.

16. Process according to claim 1, in which a surface of a system coated with oxide and exposed to water is treated in the installed state.

17. Process according to claim 1, in which the surface to be treated is of a component wetted in a water-cooled nuclear power station.

18. Process according to claim 17, in which the surface to be treated is of a component of the water circulation system.

19. Process according to claim 1, in which color is imparted to the surface.

20. Alloy comprising nickel and iron, containing at least in part of the surface an oxide layer formed by a process according to claim 1.

21. An alloy according to claim 20 which is stainless steel.

22. An alloy according to claim 20 which comprises 10–70% nickel.

* * * * *